US006328532B1

(12) United States Patent
Hähnle

(10) Patent No.: US 6,328,532 B1
(45) Date of Patent: Dec. 11, 2001

(54) BLADE COOLING

(75) Inventor: Hartmut Hähnle, Küssaberg (DE)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/450,729

(22) Filed: Nov. 30, 1999

(30) Foreign Application Priority Data

Nov. 30, 1998 (EP) ..... 98 811 184

(51) Int. Cl.[7] ..... F01D 5/18
(52) U.S. Cl. ..... 416/97 R; 416/224; 416/229 A
(58) Field of Search ..... 416/92, 96 A, 416/96 R, 224, 229 A, 97 R, 231 B; 415/115

(56) References Cited

U.S. PATENT DOCUMENTS

| | | | | |
|---|---|---|---|---|
| 3,825,984 | | 7/1974 | Linko et al. . | |
| 3,867,068 | | 2/1975 | Corsmeier et al. . | |
| 4,177,010 | | 12/1979 | Greaves et al. . | |
| 4,183,716 | * | 1/1980 | Takahara et al. | 416/96 A |
| 5,259,730 | * | 11/1993 | Damlis et al. | 416/96 A |
| 5,419,039 | * | 5/1995 | Auxier et al. | 29/889.721 |
| 6,007,296 | * | 12/1999 | Ernst et al. | 415/115 |

FOREIGN PATENT DOCUMENTS 2176315 10/1973 (FR) .

* cited by examiner

*Primary Examiner*—Edward K. Look
*Assistant Examiner*—James M McAleenan
(74) *Attorney, Agent, or Firm*—Burns, Doane, Swecker & Mathis, L.L.P.

(57) ABSTRACT

The devices according to the invention serve to direct a cooling fluid 230 in a cooled blade 210 of a turbomachine, in particular a gas turbine. In this case, the blade 210 has at least one cooling channel 213 running in the blade. According to the invention, at least one drawer 220 is arranged in at least one slot 221 of the blade 210. In a preferred embodiment of the invention, the drawer 220 arranged in the slot 221 is directly adjacent to the cover wall 212 and/or at least one side wall 211 of the blade. Furthermore, arranged in the drawer is at least one flow channel 222, which is preferably formed from a groove arranged in the drawer 220 and from the directly adjacent cover wall 212 and/or side wall 211. The flow channel 222 is connected to the cooling channel 213 by means of at least one opening 223. In addition, the cooling fluid 230 fed to the flow channel 222 flows off through a passage opening 224 in the cover wall 212 and/or the side wall 211 into the main flow flowing around the blade. A typical embodiment of the invention is shown in FIG. 2.

9 Claims, 7 Drawing Sheets

BLADE COOLING

BACKGROUND OF THE INVENTION

1. Field of the Invention

The invention relates to devices for directing the flow of a cooling fluid in a cooling channel of an internally cooled blade of a turbomachine, in particular a gas turbine.

2. Discussion of Background

The efficiency of turbomachines, in particular gas turbines, can be improved via an increase in the pressure and in the temperature of the fluid as parameters determining the cyclic process.

The fluid temperatures which are normal nowadays during the operation of turbomachines, in particular in the turbine inlet region, are already markedly above the permissible material temperatures of the components. In this case, in particular the blading of the turbine is directly exposed to the hot fluid flow. As a rule, the heat dissipation of the turbine blades, which is brought about by the heat conduction of the material, is not sufficient in order to avoid an excess temperature of the blades. Material temperatures which are too high first of all lead to a drop in the strength values of the material. In the process, crack formation often occurs in the components. In addition, in the event of the melting temperature of the material being exceeded, local or even complete destruction of the component occurs. In order to avoid these fatal consequences, it is therefore necessary to additionally cool, in particular, the turbine blades of a turbomachine.

The predominant conventional cooling method used nowadays for the cooling of blades by means of a cooling fluid, usually cooling air, is so-called convection cooling. In this case, the cooling fluid is directed through the blades, which respectively are of hollow design or provided with cooling channels. As a result of the lower temperature of the cooling fluid compared with the temperature of the blade material, a heat transfer occurs between the blade material and the cooling fluid as a result of forced convection in the cooling channels. With efficient cooling, the resulting material temperature is therefore below the maximum permissible temperature of the blade material.

At the end of the cooling channel, the cooling fluid mostly flows out into the main flow via one or more openings in the blade wall. Often, however, the cooling fluid is also directed at the end of the cooling channel into a further, internal chamber and passes from there into a further cooling channel or also into the main flow.

So-called film cooling is another method of cooling blades. In this case, a cooling fluid, usually also cooling air, which is supplied in cooling channels, is blown out through openings in the blade onto the blade surface. In the process, the cooling fluid forms a separating layer, similar to a fluid film, between the blade wall and the hot flow fluid. Thus, no direct heat transfer occurs between the hot fluid of the main flow and the blade.

Both methods have the disadvantage that the blades is not cooled uniformly everywhere. In the case of convection cooling, the heat transfer is directly dependent upon the flow conditions in the cooling channels. Higher flow velocities of the cooling fluid increase the heat transfer. In this case, regions in the blade tip in particular are often at a disadvantage, since here, in particular along the cover wall closing off the blade, there are regions having only very low flow velocities of the cooling fluid or also wake zones. It has been possible to compensate for these disadvantages hitherto only by means of very complicated shapes of the cooling channels in the blade. The production of such blades is extremely complicated and thus expensive. In addition, on account of the production of the blades by casting, one or more openings also generally remain in the blade walls, these openings having been necessary during the casting in order to fix the casting core.

SUMMARY OF THE INVENTION

Accordingly, one object of the invention is to direct the flow of a cooling fluid to a cooled blade of a turbomachine.

This object is achieved according to the invention in that at least one drawer is arranged in at least one slot of the blade in order to direct the cooling fluid. In addition to at least one cooling channel running in the blade, the blade has at least one feed opening for feeding cooling fluid into the cooling channel and also at least one further opening. The slot and the drawer extend in the blade longitudinal direction only over a section of the blade. In this case, the drawer projects at least partly into at least one cooling channel of the blade. As a result of the arrangement of the drawer, a locally altered path of the cooling channel and thus a locally altered guidance of the cooling fluid in the cooling channel result. It has been found that the heat exchange and thus the component cooling in wall regions previously at a disadvantage are improved by the arrangement of a drawer in a slot of the blade.

The slot and the drawer are preferably made with a rectangular or slit-like cross section. In this case, the cross section to be considered is the cross section perpendicular to the push-in direction of the drawer. It is especially expedient for the slot and the drawer to be dimensioned relative to one another in the form of an interference fit. Consequently, the drawer may be inserted into the slot by means of positive locking. The drawer is expediently also often brazed. Furthermore, it is of advantage to arrange the drawer in the slot perpendicularly to the blade height direction.

Both the slot and the drawer expediently extend from the suction side to the pressure side of the blade. As a result, the slot in particular can be made and machined in a simple manner from the production point of view. The outer contour of the drawer is advantageously adapted to the contour of the blade profile at the location of the slot. Thus turbulence-point-like transitions in the course of the wall contour of the blade are avoided. Such turbulence-point-like transitions would lead to higher flow losses of the main flow of the turbomachine.

In an advantageous refinement, at least the drawer has a step or a continuous cross-sectional reduction. In this case, the cross section of the drawer is advantageously reduced in the direction in which the drawer is pushed into the slot. The slot is expediently made in the same way, so that the drawer can be inserted into the slot by means of positive locking. In particular in the case of rotor blades, it is especially expedient to arranged the step in such a way that the cross section of the drawer is reduced against the direction of rotation of the rotor and the positive locking between the drawer and the slot is provided in the region of the cross-sectional reduction. It has been found that, with such an arrangement, loosening of the drawer in the slot is prevented in an especially effective manner as a result of the inertia forces acting on the drawer during an acceleration of the rotor as well as a result of the fluid-dynamic pressure forces of the flow fluid.

It is especially expedient to arrange the slot and the drawer according to the invention in such a way that the drawer arranged in the slot is directly adjacent to the cover wall and/or at least one side wall of the blade or is at least partly integrated in the cover wall and/or the side wall. In addition, the drawer arranged in this way advantageously has at least one flow channel arranged in the drawer. To this end, a groove is preferably arranged in the drawer in such a way that this groove together with the adjacent cover wall and/or an adjacent side wall of the blade forms the flow channel. The flow channel is connected via at least one opening to the cooling channel and in addition preferably has at least one outlet. In this case, the flow channel is normally made with a smaller cross section of flow than the cooling channel. It is especially expedient to design the outlet of the flow channel as a passage opening in the adjacent cover wall and/or an adjacent side wall. Provided the cooling channel has no further outlets, all the cooling fluid fed to the cooling channel therefore flows through the flow channel. If there are further outlets of the cooling channel, the cooling-fluid mass flow is split up accordingly. If a plurality of cooling channels are arranged in the blade or if the cooling channel is subdivided into partial channels, the outlet of the flow channel may expediently also open out into a further cooling channel or a further partial channel of the cooling channel. It has been found that, by means of such a flow channel, the cooling fluid can be directed specifically along the adjacent cover wall and/or the adjacent side wall. This permits specific cooling of wall regions which previously were badly cooled or were not cooled at all. In addition, it has been found that the cooling effect of the cooling fluid directed in such a flow channel is often increased. This is due to the increased heat transfer as a result of higher flow velocities inside the flow channel compared with the flow velocity of the cooling fluid in the cooling channel of the blade.

In an especially expedient manner, turbulence elements, which lead to an increase in the degree of turbulence of the cooling fluid flowing through the flow channel, are arranged in the flow channel. As a result, the heat transfer of the cooling fluid to the side walls is again increased and the cooling effect is thus augmented. For example, simple transverse webs in the flow channel may be used as such turbulence elements.

Furthermore, it is advantageous to arrange the slot and the drawer in such a way that the drawer arranged in the slot is directly adjacent to the cover wall and/or at least one side wall or is at least partly integrated in the cover wall and/or the side wall and in the process at least partly closes at least one opening of the cooling channel. This is of advantage in particular when the cooling channel, in addition to the inlet and the outlets, has further openings or even openings which are too large, through which the cooling fluid would escape too rapidly. Such openings may occur, for example, as a result of casting-core mountings owing to the casting technique.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
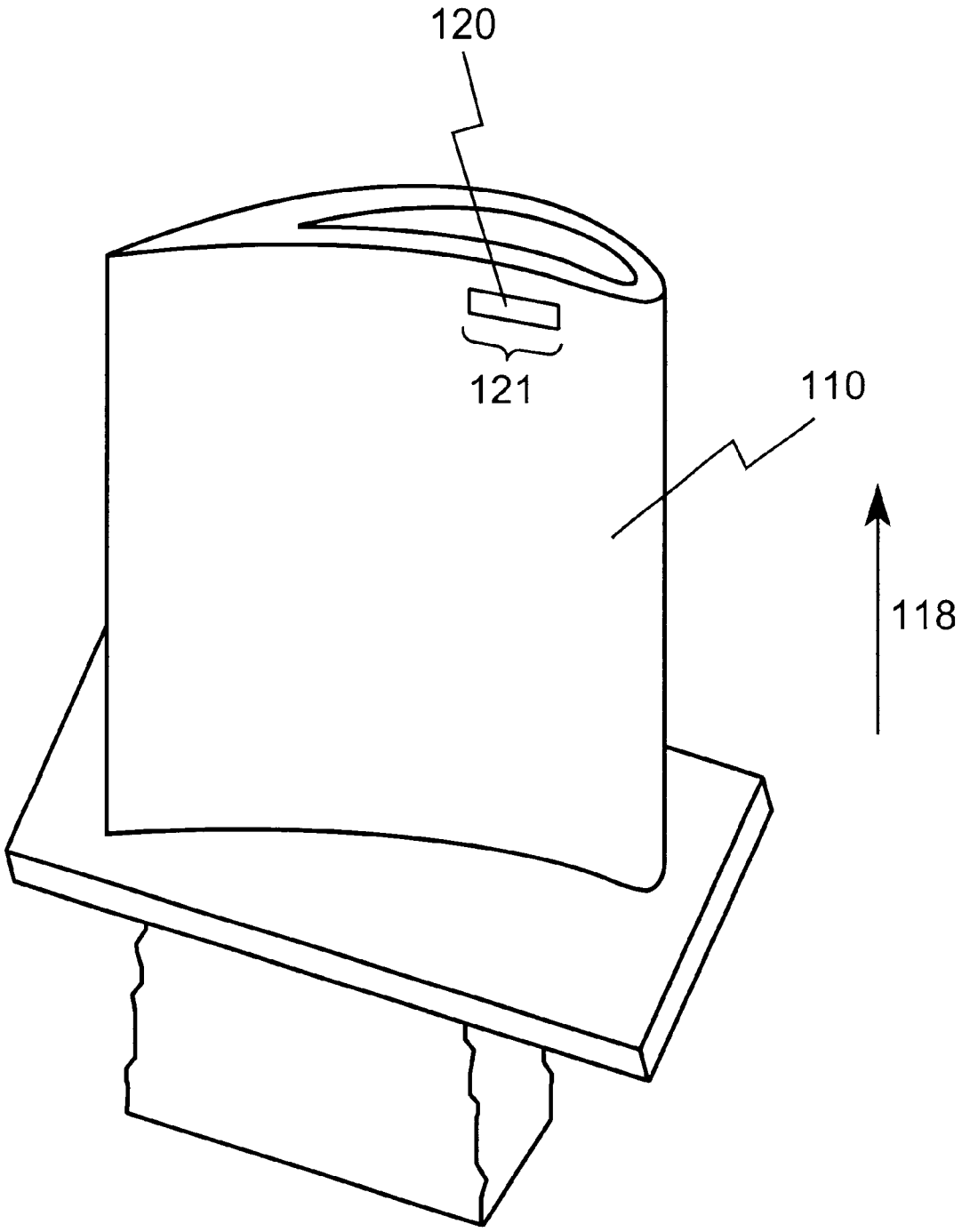
FIG. 1 shows a perspective view of a blade with a slot in the region of the blade tip and a drawer arrange in the slot.

Referring now to the drawings, wherein like reference numerals designate identical or corresponding parts throughout the several views, FIG. 1 shows an internally cooled blade 110 of a turbomachine, having a slot 121 according to the invention and a drawer 120 arrange according to the invention in the slot. The blade 110 shown is designed to be shroudless in the region of the drawer 120. The cooling channel running in the blade 110 is not shown in FIG. 1. The slot 121 and the drawer 120, in an advantageous configuration, are arranged here in the region of the blade tip approximately perpendicularly to the blade height direction 118. In the embodiment shown, the slot 121 and the drawer 120 are arranged in the blade in the region of maximum blade thickness and extend only over a section of the blade in the blade longitudinal direction. However, the drawer and the slot may also be arranged in a blade at a different position of the blade to that shown. According to the representation, the slot 121 and the drawer 120 have a rectangular cross section. The cross section considered in this case is the cross section perpendicular to the push-in direction of the drawer. The dimensions of the slot 121 and of the drawer 120 are expediently realized here relative to one another as an interference fit. Furthermore, the drawer is fixed in the slot by means of brazing. It is thereby possible in a simple and cost-effective manner to fasten the drawer in the slot. The outer contour profile of the drawer 120 is adapted to the blade profile contour at the location of the slot. Consequently, turbulence-point-like transitions in the contour profile of the blade are avoided.

Figure 2:
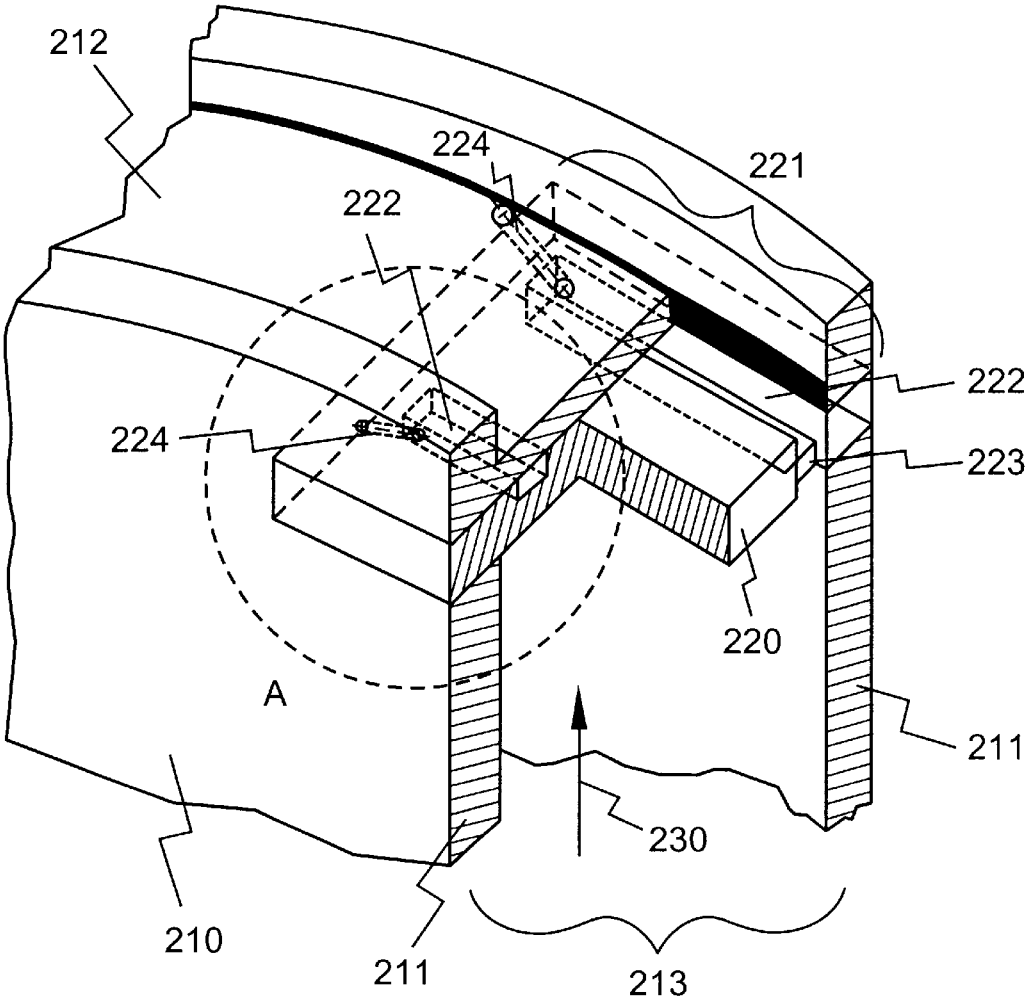
FIG. 2 shows a perspective section through a blade with a slot and a drawer, arranged in the slot and adjacent to the cover wall of the blade, and two flow channels running in the drawer.

In FIG. 2, the arrangement according to the invention of the drawer 220 in the slot 221 of the blade 210 is shown perspectively in a section through the blade 210. The blade 210, which is designed to be hollow on the inside, has in addition to a pressure-side and a suction-side side wall 211 a cover wall 212 closing off the cavity inside of the blade. The cavity inside the blade serves here as a single-part cooling channel 213 of the blade 210. The cooling fluid 230 is fed to the blade through a feed opening (not shown in the figure) in the blade root.

The drawer 220 shown in FIG. 2 is arranged in the slot 221 in the blade tip region approximately perpendicularly to the blade height direction. In the blade longitudinal direction, the slot 221 and the drawer 220 extend only over a section of the blade 210, whereas both the slot 221 and the drawer 220 extend continuously in the blade thickness direction from the pressure side to the suction side of the blade. The contours of the drawer 220 which are on the outside of the blade are expediently adapted to the outer profile contours of the blade 210, thus to the pressure-side and suction-side blade profile contours. The slot 221 and the drawer 220 are made with respective cross sections matched to one another and are fitted together by means of an interference fit. Here, the flat top side of the drawer 220 is directly adjacent to that side of the cover wall 212 which is inside the blade. In addition, in the embodiment of the invention shown, the drawer 220 has a plurality of grooves such that two grooves arranged separately from one another on the top side of the drawer 220 form two flow channels 222 together with the cover wall 212. These two flow channels 222 therefore run parallel to and along the cover wall 212. The flow channels 222 are connected to the cooling channel 213 of the blade 210 via further openings 223 arranged in the front end face of the drawer 220. Cooling fluid 230 can therefore flow out of the cooling channel 213 into the flow channels 222. Although the flow channels 222 shown and the openings 223 are made as rectangular grooves, the groove designs are in principle freely selectable. In order to enable the cooling fluid 230 fed from the cooling channel 213 to flow off from the flow channels 222, an outlet 224 realized as a passage opening is arranged for each flow channel 222 in the cover wall 212 or in the side wall 211.

Figure 3:
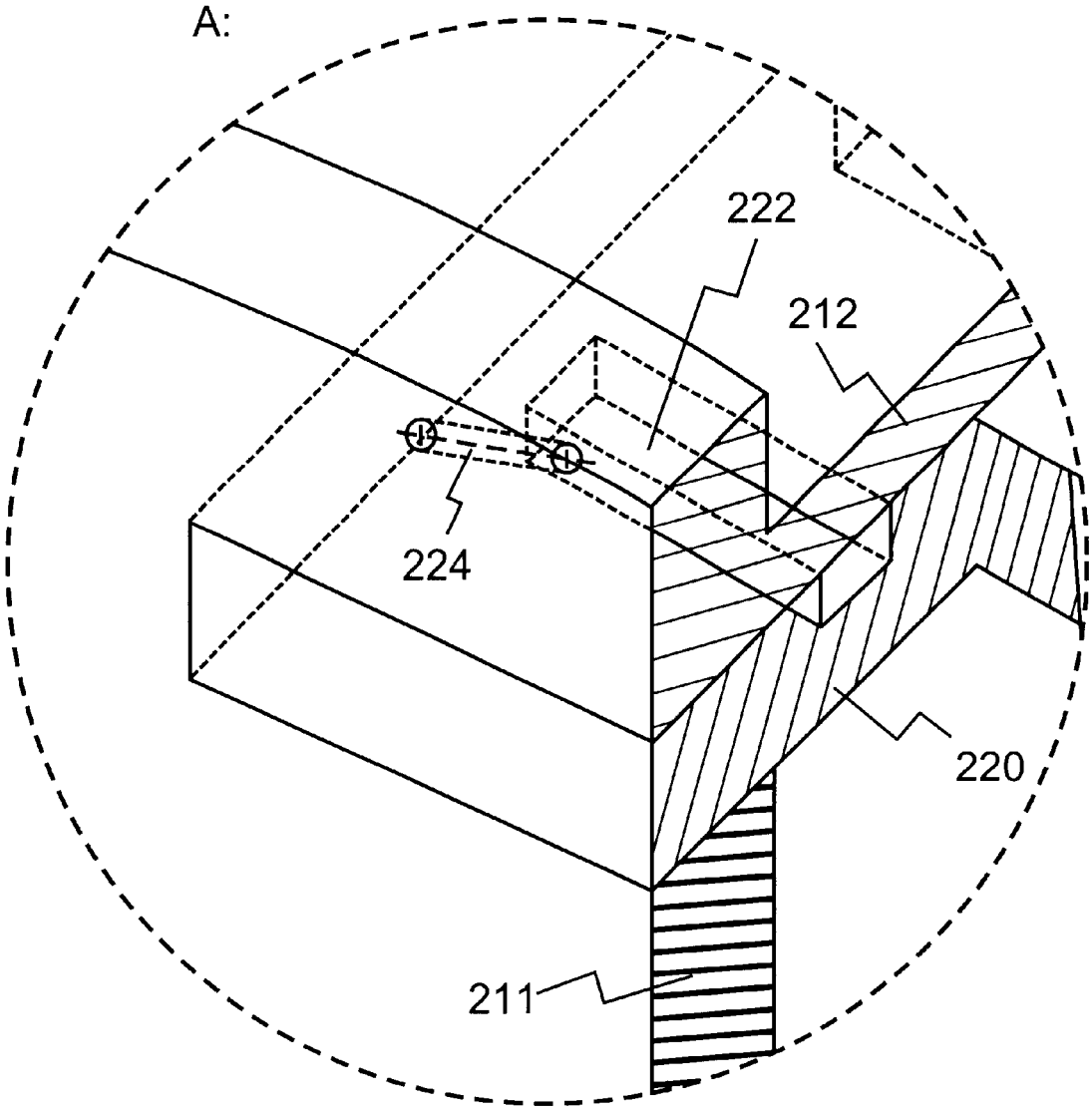
FIG. 3 shows an enlargement of the flow channel and of the outlet of the flow channel in FIG. 2.
Figure 3A:
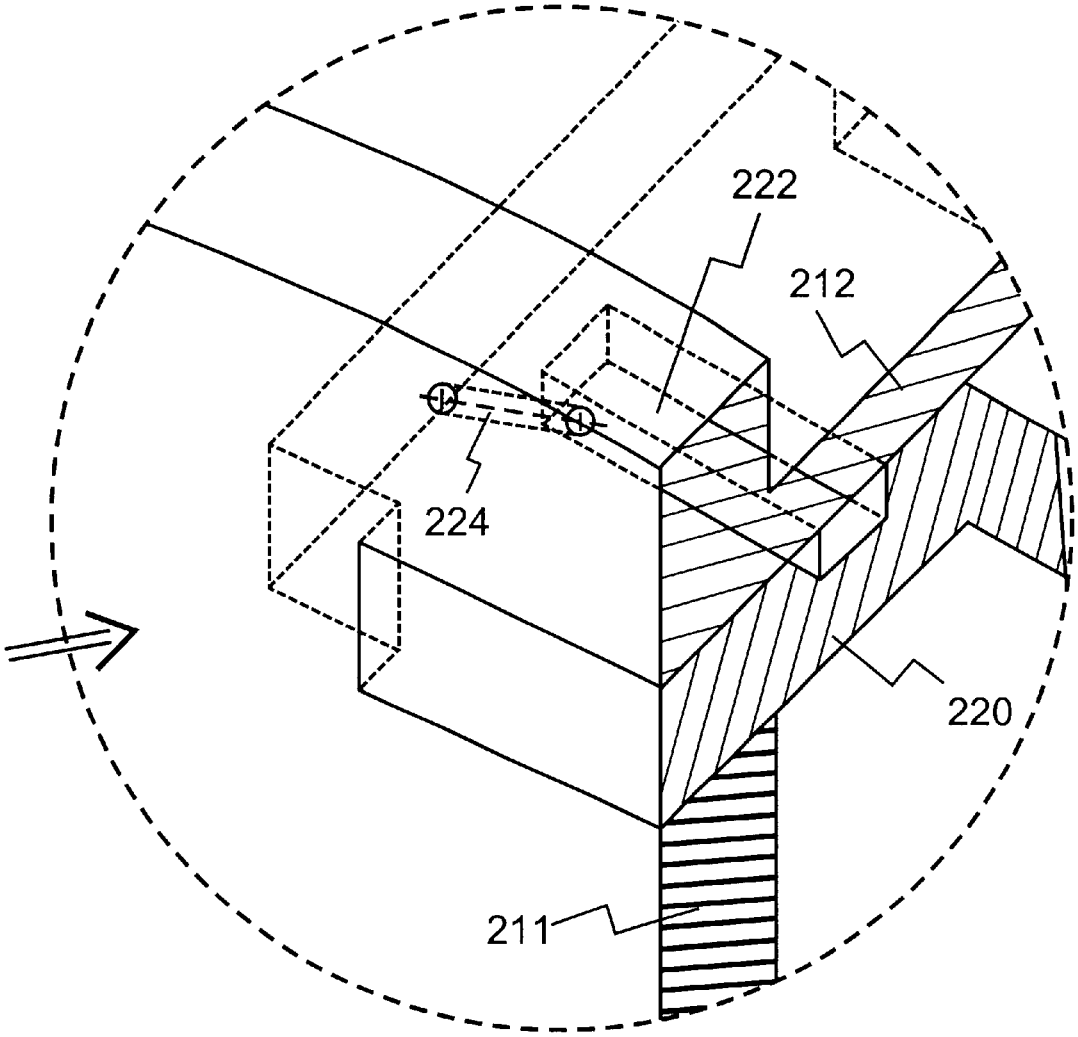
FIG. 3A shows a perspective view of a blade with both drawer and slot having a stepped, cross-section reduction.
Figure 3B:
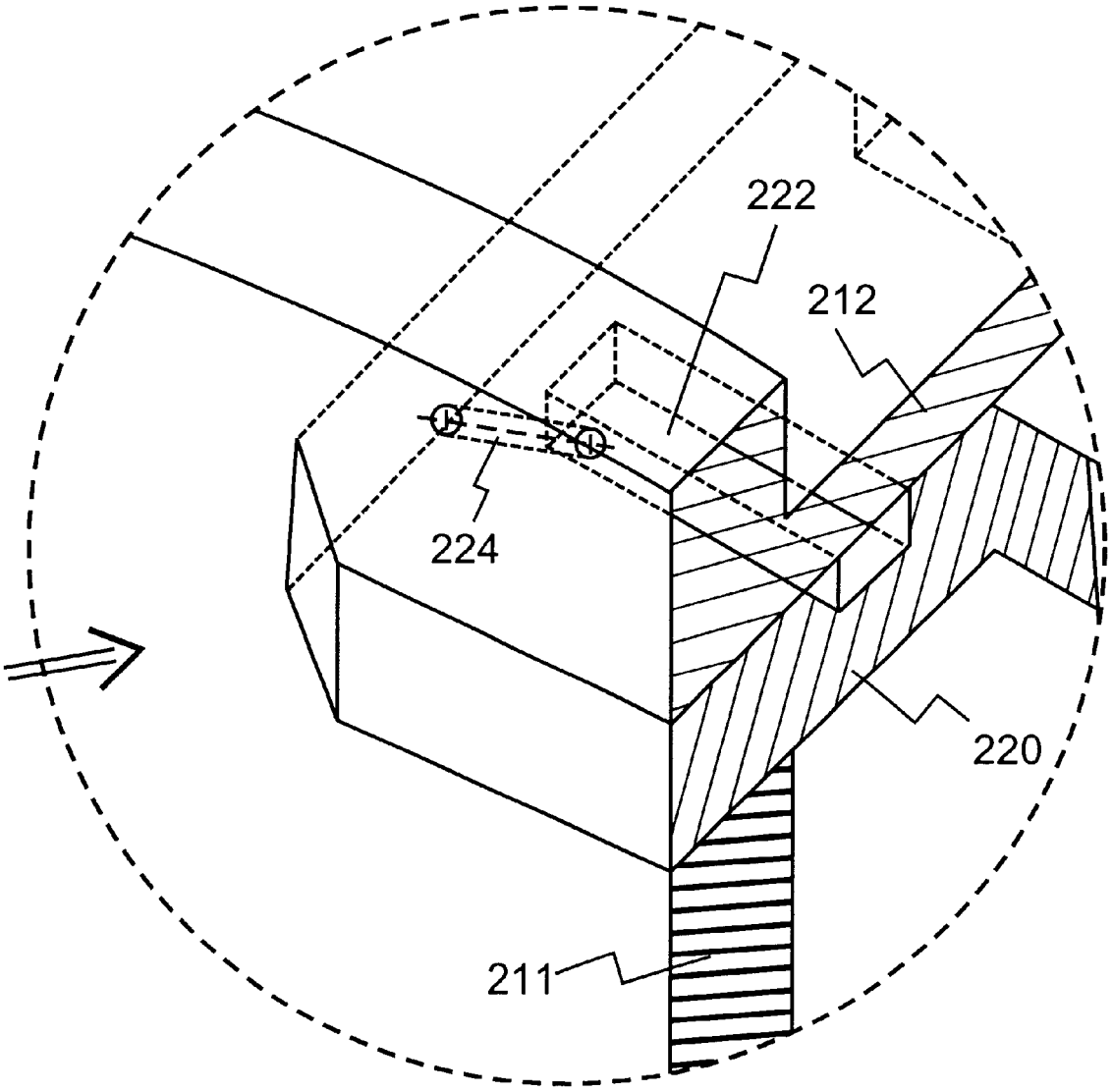
FIG. 3B shows a perspective view of a blade with both drawer and slot having a continuously reducing cross section.
Figure 3C:
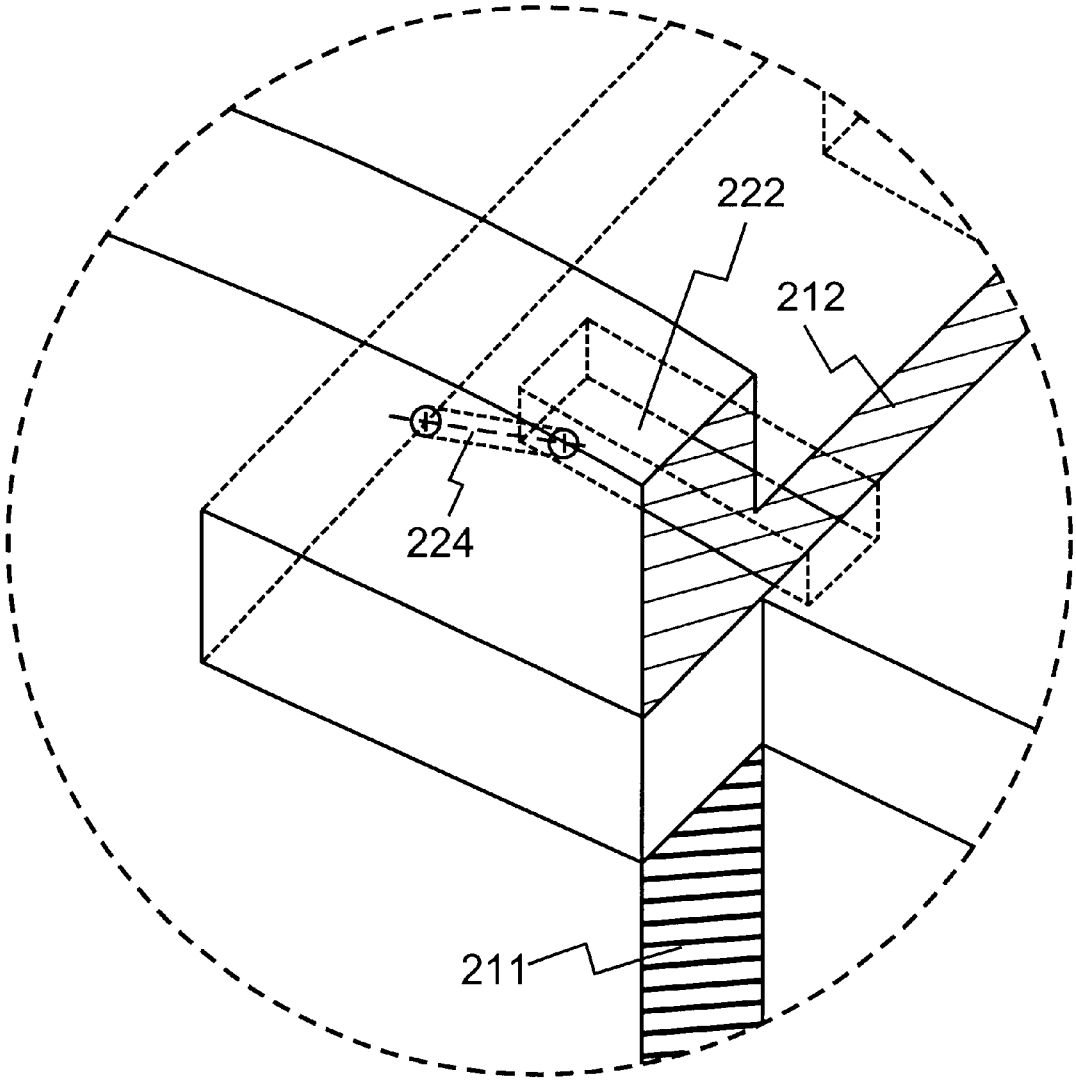
FIG. 3C shows a perspective view of a blade where the drawer has a step, but the slot does not have a cross-sectional reduction.

FIG. 3 shows the arrangement of the passage opening 224 in the side wall 211 of the blade in an enlarged view. The passage opening 224 is made here as a bore and runs so as to be set at an angle with respect to the surface of the side wall 211. In this case, the passage opening opens out into the flow channel 222 at the closed end of the latter. Here, the setting angle of the passage openings 224 has advantageously been selected in such a way that discharging fluid has as small a displacement angle as possible relative to the main flow flowing around the blade. If the cooling fluid 230 in the blade 210 has a higher static pressure than the main-flow fluid flowing around the blade, the cooling fluid fed from the cooling channel 213 to the flow channel 222 flows out through the passage openings 224 into the main flow. A continuous cooling-fluid flow therefore forms through the flow channels and the passage openings. In the process, a heat exchange occurs between the cooling fluid 230 and the wall (cover wall 212 and/or side wall 211) adjacent to the flow channel 222 and thus specific cooling of the adjacent wall occurs. In addition, on account of the smaller cross section of flow of the flow channel 222 compared with the cross section of flow of the cooling channel 213, the cooling fluid 230 also flows through the flow channel with increased velocity. This higher flow velocity leads to an additional increase in the heat transfer and thus to improved cooling of the wall.

Figure 4:
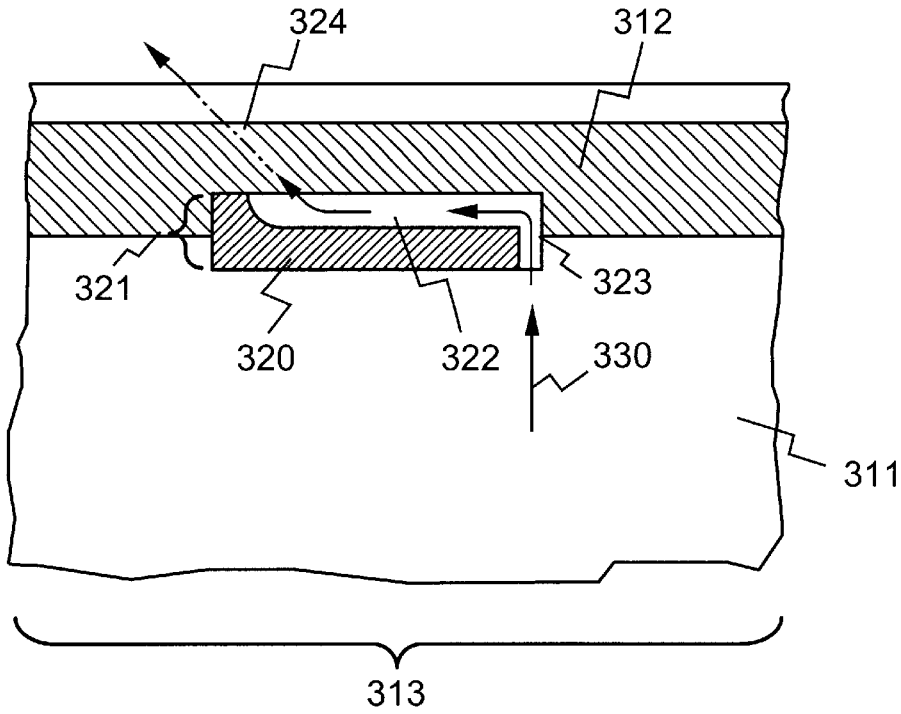
FIG. 4 shows a section through a blade in side view, with a drawer adjacent to the cover wall of the blade, the drawer having a flow channel, from which the cooling fluid flows out into the main flow.

FIG. 4, in side view, shows a section through an internally cooled blade with a further configuration of the drawer 320 arranged according to the invention in the slot 321. The section runs through the center of the blade and, in addition to the the cover wall 312 (shown sectioned) of the blade, shows a detail of the cooling channel 313 running in the blade.

Here, the arrangement of the slot 321 has been selected in such a way that part of the slot 321 extends into the cover wall 312. The drawer 320 inserted into the slot 321 is likewise fitted here proportionally into the cover wall 312. In the same way as the slot 321, the drawer 320 expediently has a rectangular cross section. The drawer is thus positioned in the slot by means of positive locking. In principle, however, the drawer and the slot may also be designed with other cross sections, for example with oval, trapezoidal, rhombic or even polygonal cross sections, although these cross sections in turn must then be matched to one another in each case. In addition, the drawer 320, in the embodiment shown, has two grooves, which in FIG. 4 are shown in section through the center. In this case, the groove arranged on the top side of the drawer forms together with the adjacent cover wall 312 a flow channel 322 running parallel to the cover wall on the underside of the cover wall. This flow channel 322 is connected to the cooling channel 313 via the opening 323, which is formed by the second groove arranged at the end face of the drawer 320. The opening 323 could likewise be made as a bore provided in the drawer, Furthermore, a passage opening 324 is made in the cover wall 312 by means of a bore set at an angle. This passage opening 324 opens out into the flow channel 322 at the end of the latter closed toward the cooling channel. Cooling fluid 330 flows out of the cooling channel 313 via the flow channel 322 arranged in the drawer 320 into the passage opening 324 and from there onto the top side of the cover wall 312 and thus into the main flow flowing around the blade. Specific cooling of the wall adjacent to the flow channel 322 occurs by means of the cooling fluid 330 directed in the flow channel 322. Furthermore, the passage opening 324, on account of the upstream arrangement of the flow channel 322 and the pressure loss produced in the flow channel 322, can be made with a large cross section compared with an arrangement without an upstream flow channel. This leads to less risk of obstruction of the passage openings on account of foreign particles during the operation of a turbomachine.

Figure 5:
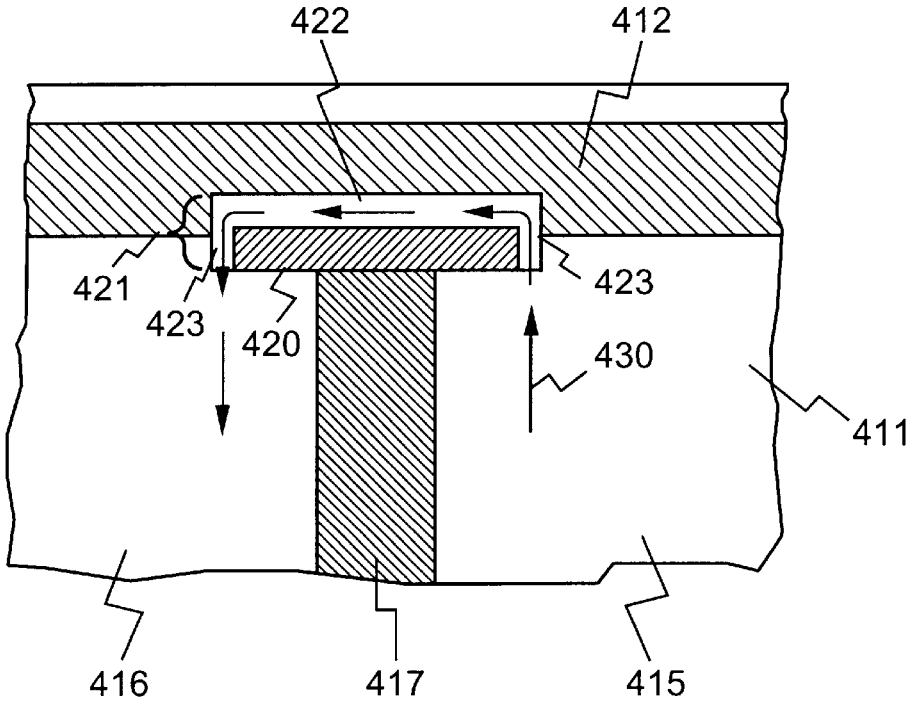
FIG. 5 shows a section through a blade in side view, with a composite cooling channel, subdivided by a partition wall, and a drawer adjacent to the cover wall of the blade, the drawer having a flow channel, from which the cooling fluid flows out of the first partial channel of the cooling channel into the second partial channel of the cooling channel.

A further embodiment of the invention is depicted in FIG. 5 in a section through an internally cooled blade. Here, the cooling channel shown is subdivided into two partial channels 415, 416 by a partition wall 417. The arrangement according to the invention of the drawer 420 in the slot 421 of the blade in the embodiment of the invention shown here corresponds to the arrangement according to FIG. 4. In this case, this correspondence does not restrict the configurations of the invention in FIGS. 4 and 5 which can be selected freely and independently of one another. Unlike FIG. 4, the cooling fluid 430 does not issue into the main flow but is deflected by means of the drawer 420 from the first partial channel 415 of the cooling channel into the second partial channel 416. To this end, the flow channel 422 arranged in the drawer 420 is in each case connected by means of an opening 423 to the respective partial channels 415, 416. In this case, the cooling fluid 430 flowing out of the first partial channel 415 in the flow channel 422 along the cover wall 412 into the second partial channel 416 leads to specific cooling of the cover wall 412.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A blade of a turbomachine, having a cooling channel which runs in the blade and through which a cooling fluid flows, the cooling channel having a feed opening and at least one further opening, wherein at least one drawer is arranged in at least one slot of the blade in order to continuously direct the cooling fluid, and the drawer and the slot are arranged perpendicularly or approximately perpendicularly to the blade height direction.

2. The blade as claimed in claim 1, in which the drawer and the slot are made with a rectangular or slit-like cross section.

3. A blade of a turbomachine, having a cooling channel which runs in the blade and through which a cooling fluid flows, the cooling channel having a feed opening and at least one further opening, wherein at least one drawer is arranged in at least one slot of the blade in order to direct the cooling fluid and in which at least one of the drawer and the slot has a step or a continuous cross-sectional reduction.

4. The blade as claimed in claim 1, in which the drawer and the slot extend continuously from the suction side to the pressure side of the blade, the outer contour of the drawer being adapted to the blade profile.

5. The blade as claimed in claim 1, in which the drawer arranged in the slot is directly adjacent to the cover wall and/or the side wall or both side walls of the blade, and in which the drawer at least partly closes at least one opening of the cooling channel.

6. The blade as claimed in claim 1, in which the drawer arranged in the slot is directly adjacent to a cover wall and/or a side wall or both side walls of the blade, and in which at least one flow channel is arranged in the drawer, this flow channel being connected via at least one opening to the cooling channel and having at least one outlet.

7. A blade of a turbomachine, having a cooling channel which runs in the blade and through which a cooling fluid flows, the cooling channel having a feed opening and at least one further opening, wherein at least one drawer is arranged in at least one slot of the blade in order to direct the cooling fluid, the drawer being arranged in the slot directly adjacent to a cover wall and/or a side wall or both side walls of the blade, and in which at least one flow channel is arranged in the drawer, this flow channel being connected via at least one opening to the cooling channel and having at least one outlet in which the flow channel is formed by means of a grooved arranged in the drawer and by means of the adjacent cover wall and/or an adjacent side wall of the blade.

8. The blade as claimed in claim 6, in which the outlet is designed as a passage opening in the adjacent cover wall and/or an adjacent side wall of the blade.

9. The blade as claimed in claim 6, in which turbulence elements are arranged in the flow channel.

* * * * *